US008471453B2

(12) United States Patent
Guyot et al.

(10) Patent No.: US 8,471,453 B2
(45) Date of Patent: Jun. 25, 2013

(54) HALL EFFECT ION EJECTION DEVICE

(75) Inventors: Marcel Guyot, Droue sur Drouette (FR); Patrice Renaudin, Tremblay les Villages (FR); Vladimir Cagan, Bagnolet (FR); Claude Boniface, Bruyeres-le-Chatel (FR)

(73) Assignees: Centre National de la Recherche Scientifique (CNRS), Paris (FR); Universite de Versailles St Quentin en Yvelines, Versailles (FR); Centre National d'Etudes Spatiales, Paris (FR)

( * ) Notice: Subject to any disclaimer, the term of this patent is extended or adjusted under 35 U.S.C. 154(b) by 447 days.

(21) Appl. No.: 12/671,168

(22) PCT Filed: Aug. 4, 2008

(86) PCT No.: PCT/EP2008/060241
§ 371 (c)(1),
(2), (4) Date: Apr. 12, 2010

(87) PCT Pub. No.: WO2009/016264
PCT Pub. Date: Feb. 5, 2009

(65) Prior Publication Data

US 2010/0244657 A1 Sep. 30, 2010

(30) Foreign Application Priority Data

Aug. 2, 2007 (FR) ..... 07 05658

(51) Int. Cl.
*H01J 27/02* (2006.01)

(52) U.S. Cl.
USPC ..... 313/361.1; 313/359.1

(58) Field of Classification Search
USPC ..... 313/359.1, 361.1; 315/111.81, 111.61, 315/111.51, 111.71, 111.41, 501; 250/427, 250/492.21, 251; 204/298.04, 298.03, 298.08
See application file for complete search history.

(56) References Cited

U.S. PATENT DOCUMENTS 5,218,271 A 6/1993 Egorov et al.
5,359,258 A 10/1994 Arkhipov et al.

(Continued)

FOREIGN PATENT DOCUMENTS

FR 2 743 191 12/1996
FR 2 842 261 7/2002

OTHER PUBLICATIONS

Tang, D. et al.,"Characteristics of end Hall ion source with magnetron hollow cathode discharge" Nuclear Instruments and Methods in Physics Research Part B 257, Jan. 19, 2007, pp. 796-800.

(Continued)

*Primary Examiner* — Anh Mai
*Assistant Examiner* — Elmito Breval
(74) *Attorney, Agent, or Firm* — Harness, Dickey & Pierce, P.L.C.

(57) ABSTRACT

The disclosure relates to a Hall-effect ion ejection device that comprises a longitudinal axis substantially parallel to the ion ejection direction, and comprises at least: a main ionization and acceleration annular channel, the annular channel being open at its end; an anode extending inside the channel; a cathode extending outside the channel at the outlet thereof; a magnetic circuit for generating a magnetic field in a portion of the annular channel, said circuit including at least an annular inner wall, an annular outer wall and a bottom connecting the inner and outer annular walls and defining the downstream portion of the magnetic circuit; characterized in that the magnetic circuit is arranged so as to create at the outlet of the annular channel a magnetic field independent from the azimuth.

18 Claims, 3 Drawing Sheets

U.S. PATENT DOCUMENTS

| | | | |
|---|---|---|---|
| 5,475,354 | A | 12/1995 | Valentian et al. |
| 5,646,476 | A | 7/1997 | Aston |
| 5,763,989 | A | 6/1998 | Kaufman |
| 5,838,120 | A | 11/1998 | Semenkin et al. |
| 5,847,493 | A | 12/1998 | Yashnov et al. |
| 5,945,781 | A | 8/1999 | Valentian |
| 6,281,622 | B1 | 8/2001 | Valentian et al. |
| 6,612,105 | B1 | 9/2003 | Voigt et al. |
| 7,461,502 | B2 | 12/2008 | Emsellem |
| 7,543,441 | B2 | 6/2009 | Cagan et al. |
| 2005/0116652 | A1 | 6/2005 | McVey et al. |
| 2005/0247885 | A1 | 11/2005 | Madocks |

OTHER PUBLICATIONS

Zhurin, V.V. et al., "Physics of closed drift thrusters", Plasma Sources Science Technology, 1999, pp. R1-R20.

Choueiri, E.Y., "Plasma oscillations in Hall thrusters", Physics of Plasmas, vol. 8, No. 4, Apr. 2001, pp. 1411-1426.

Kim. Vladimir, "Main Physical Features and Processes Determining the Performance of Stationary Plasma Thrusters", Journal of Propulsion and Power, vol. 14, No. 5, Sep.-Oct. 1998, pp. 736743.

Cadiou, A. et al., "La propulsion à plasma: enjeu scientifique, technologique et économique pour l'avenir du spatial européen", Lettres Des Departements Scientifiques Du Cnrs, 2004, 35 pages.

Morozov, A. I. et al., "Fundamentals of Stationary Plasma Thruster Theory", Consultant Bureau, New York, 2000), pp. 203-391.

Smit., J. et al. "Intrinsic Properties of Ferrites with Spinel Structure", Philips Tech Library Chapter VIII, 1959, pp. 136-161.

"Single-Particle Motions", Chapter Two, pp. 19-51.

Bouchoule A. et al., "An Overview of the French Research Program on Plasma Thrusters for Space Applications", Contributions to Plasma Physics, 41(6), 2001, pp. 573-588.

HALL EFFECT ION EJECTION DEVICE

CROSS-REFERENCE TO RELATED APPLICATIONS

This application is a National Phase Entry of International Application No. PCT/EP2008/060241, filed on Aug. 4, 2008, which claims priority to French Application 07 05658, filed on Aug. 2, 2007, both of which are incorporated by reference herein.

BACKGROUND AND SUMMARY

The present invention relates to the field of Hall effect ion ejection devices and more particularly to the field of plasma thrusters.

In the aerospace field, the use of plasma thrusters is well known for notably maintaining a satellite on a geostationary orbit, for moving a satellite from one orbit to a second orbit, for compensating drag forces on satellites placed on a so-called low orbit, i.e. with an altitude comprised between 200 and 400 km, or for propelling a space craft during an interplanetary mission requiring low thrusts over very long time periods. These plasma thrusters generally have an axisymmetrical shape around a longitudinal axis substantially parallel to an ion ejection direction and include at least one main ionization and acceleration channel, obtained in a refractory material surrounded by two circular cylindrical poles, the annular channel being open at its end, an annular anode extending inside the channel, a cathode extending outside the channel, at the outlet of the latter, generally duplicated with a second redundant anode, and a magnetic circuit for generating a magnetic field in a portion of the annular channel. The magnetic field is usually generated by means of electric coils powered by electric generators connected to solar panels.

Although the theoretical operation of these thrusters is still not perfectly mastered, it is generally recognized that they operate in the following way. Electrons emitted by the cathode head towards the anode from the upstream portion to the downstream portion of the annular channel. A portion of these electrons is trapped in the annular channel by the interpolar magnetic field. Impacts between electrons and gas molecules contribute to ionizing the gas introduced into the annular channel through the anode. The mixture of ions and electrons then forms a self-sustaining ionized plasma. The ions ejected downstream under the effect of the electric field generate a thrust of the engine directed in the upstream direction. The ion jet is electrically neutralized by electrons emitted by the cathode 2.

Such plasma thrusters are for example described in American U.S. Pat. No. 5,359,258 and U.S. Pat. No. 6,281,622. Although these thrusters provide an ion ejection velocity, 5 times higher than the ejection velocity provided by chemical thrusters thereby providing a significant reduction in the weight and bulkiness of spacecraft such as satellites for example, this type of thruster has the drawback of requiring heavy and bulky electric generators, and of being expensive. In order to find a remedy to these drawbacks, plasma thrusters with, for a same thrust, reduced consumption of electric current and therefore a reduced mass of electric generators, reduced mass and bulkiness of the magnetic circuit, increased reliability and reduced production cost have already been devised.

This is the case of French patent application FR 2 842 261, for example, which describes a Hall effect plasma thruster, for which at least one of the arms of the magnetic circuit includes a permanent magnet. Said thruster has a longitudinal axis substantially parallel to a propulsive direction defining an upstream portion and a downstream portion, and includes a main ionization and acceleration annular channel made in a refractory material surrounded by two circular cylindrical magnetic poles, the annular channel being open at its upstream end, a gas-distributing annular anode receiving gas from distribution conduits and provided with passages for letting this gas enter the annular channel, said annular anode being placed inside the channel in a downstream portion of the latter, at least one hollow cathode being positioned outside the annular channel, adjacently to the latter, a magnetic circuit including upstream polar ends for generating a radial magnetic field in an upstream portion of the annular channel between these polar portions, this circuit being formed by a downstream plate, from which a central arm located in the centre of the annular channel, two circular cylindrical poles on either side of the annular channel and peripheral arms located outside the annular channel and adjacent to the latter, spring out upstream parallel to the longitudinal axis. At least one of the arms of the magnetic circuit includes a permanent magnet so that the coils for generating the magnetic field have a reduced number of turns, wound in a special high temperature wire. Thus, the reduction in the number of turns allows a reduction in the losses by the Joule effect causing a reduction in the heating of the thruster, an increase in the reliability of the thruster and a reduction in the production cost, the high temperature special wire being brittle and expensive. However, this type of thrusters remains unsuitable for small size thrusters intended for certain applications such as the propulsion of small satellites for example.

Document US 2005/116652 is also known, which describes a plasma thruster with ion ejection including two concentric ionization and acceleration annular channels, one anode extending inside each channel and one cathode extending outside the channels at the outlet of the latter. Said thruster includes a magnetic circuit consisting of electric coils or annular permanent magnets. Moreover, document US 2005/0247885 describes a Hall effect plasma thruster including an ionization and acceleration annular channel, an anode extending inside the channel, a cathode extending outside the channel at the outlet of the latter and a magnetic circuit for generating a magnetic field in the annular channel. The magnetic circuit consists of permanent magnets, a central annular permanent magnet integral with the inner wall of the magnetic circuit and a peripheral annular permanent magnet which is integral with the outer wall and a so-called shunt magnet extending at the bottom of the annular channel. The plasma thruster moreover includes shunt elements with which the magnetic field may be concentrated in order to generate a mirror magnetic field at the outlet of the annular channel, said mirror magnetic field being relatively symmetrical between the poles of the permanent magnets.

Further, document U.S. Pat. No. 5,763,989 describes a plasma thruster including an ionization and acceleration annular channel, an anode extending inside the channel, a cathode extending outside the channel and a magnetic circuit in order to generate a magnetic field in a portion of the annular channel. The magnetic circuit consists of permanent magnets, a central permanent magnet and a peripheral annular permanent magnet. In order to suppress the magnetic field at the anode, the device includes shielding which locally deforms the field lines in proximity to the anode. All these devices require the use of shielding in order to avoid any breakdown at the anode and are unsuitable for small size thrusters.

One of the objects of the invention is therefore to find a remedy for all these drawbacks by proposing an ion ejection device particularly suitable for making a plasma thruster of simple design, inexpensive and having low bulkiness. For this purpose and according to the invention, a Hall effect ion ejection device is proposed, having a longitudinal axis substantially parallel to an ion ejection direction and including at least one main ionization and acceleration annular channel, the annular channel being open at its end, an anode extending inside the channel, a cathode extending outside the channel, at the outlet of the latter, and a magnetic circuit in order to generate a magnetic field in a portion of the annular channel into which a noble gas is introduced, said circuit comprising at least one annular inner wall, one annular outer wall and a bottom connecting the inner and outer walls and forming the downstream portion of the magnetic field; said device is remarkable in that the magnetic circuit is laid out so as to generate at the outlet of the annular channel a magnetic field independent of azimuth and, in the area of the anode, a magnetic field for which the radial component is zero.

It will be noted that the fact that the magnetic field is independent of azimuth, provides at the outlet of the annular channel a globally constant and quasi-radial magnetic field regardless of the azimuth. In this way, the electrons arriving in the outlet area of the annular channel with a velocity parallel to the axis of revolution of the device are subjected to a Laplace force which imparts a cyclotron movement to them in the outlet plane of the annular channel. The electrons are thus massively trapped in the outlet area causing an increase in the probability of ionizing collisions with the atoms of the noble gas. Further, the radial component of the magnetic field is zero in the area of the anode; the device does not require shielding in order to deform the field lines.

The device includes a so-called central annular permanent magnet integral with the inner wall of the magnetic circuit and a so-called peripheral annular permanent magnet integral with the outer wall of the magnetic circuit and for which the magnetization direction is opposite that of the central magnet. Moreover, the bottom of the annular groove includes an annular through-recess forming a gap. Advantageously, the central and/or peripheral magnet includes a plurality of magnetic elements positioned in a circular way. Further, the central and/or peripheral magnet includes one or more amagnetic elements. Each magnetic element of the peripheral magnet has a determined power. Said elements of the central and/or peripheral magnet are cylinders obtained in a metal SmCo alloy.

According to an alternative embodiment of the device according to the invention, the central and/or peripheral magnet is obtained in hard ferrites, so-called hexaferrites. Advantageously, the magnetic circuit is obtained in soft ferrites which are preferably selected from the following list of ferrites of general formula $MFeO_4$ or MO, $Fe_2O_3$.

Moreover, the device includes an annular part obtained in a porous refractory material and positioned in the bottom of the annular groove in order to cap the gap and close the bottom of the annular channel. This annular part is preferably obtained in porous ceramic. Further, the anode has an annular shape and extends in the middle portion of the annular channel. The device will find many industrial applications 1 such as a Hall effect plasma thruster or a device for a surface treatment with ionic implantation for example.

BRIEF DESCRIPTION OF DRAWINGS

Other advantages and characteristics will become better apparent from the description which follows of several alternative embodiments, given as non-limiting examples, of the Hall effect electron ejection device according to the invention, from the appended drawings wherein.

DETAILED DESCRIPTION

Figure 1:
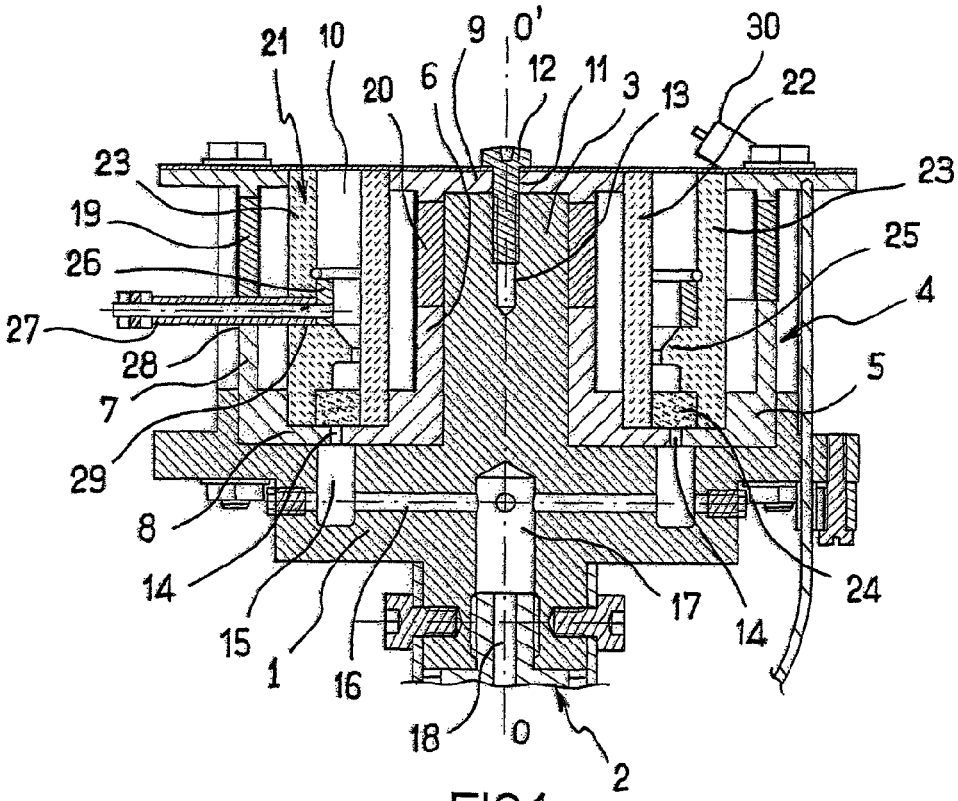
FIG. 1 is an axial sectional view of a plasma thruster according to the invention.

A Hall effect electron ejection device of a plasma thruster will be described hereafter; however, the electron ejection device may find many applications notably as a source of ions for industrial treatments such as notably deposition in vacuo, deposition assisted by ion production so-called IAD according to the acronym "Ion Assisted Deposition", dry etching of microcircuits or any other device for surface treatment by ion implantation. With reference to FIG. 1, the plasma thruster according to the invention consists of a base 1 having an axisymmetrical shape around an axis OO' and including in its downstream portion, i.e. in its rear portion, a circuit 2 for supplying a noble gas such as for xenon, for example capable of being ionized, and in its upstream portion i.e. in its front portion, a cylindrical central core 3, ejection of the ions being carried out in the downstream to upstream direction as this will be detailed later on.

Figure 2:
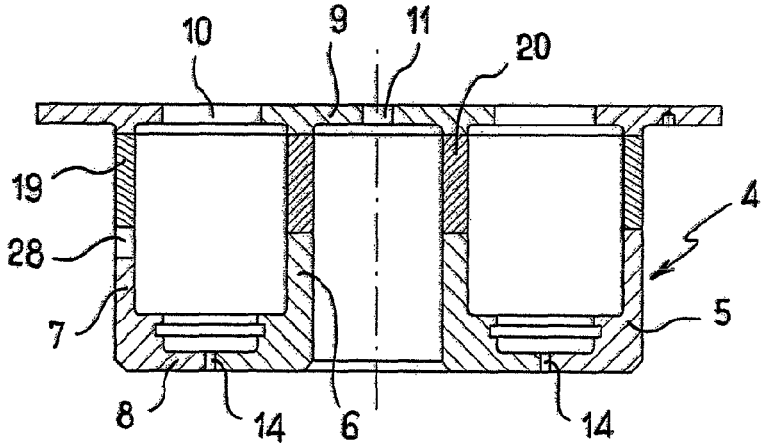
FIG. 2 is an axial sectional view of the magnetic circuit of the plasma thruster according to the invention illustrated in FIG. 1.

The thruster moreover includes a magnetic circuit 4, illustrated in FIGS. 1 and 2, consisting of a crown 5 with a U-shaped section comprising an inner wall 6, an outer wall 7 and a bottom 8 connecting the inner 6 and outer 7 walls and forming the downstream portion of the magnetic circuit 4. The upstream portion of the magnetic circuit 4 consists of a disk 9 capping the crown 5. Said disk 9 includes an annular lumen 10 extending facing the bottom 8 of the crown 5, and a hole 11 for letting through a screw 12 (FIG. 1) allowing the magnetic circuit 4 to be firmly secured to the base 1, the central core 3 including a tapped hole 13 capable of receiving the screw 12. The magnetic circuit 4 moreover includes in its bottom 8 an annular recess 14 forming a gap and opening out onto an annular groove 15 fed by radial secondary ducts 16 connected to a distributor 17 fed by a main duct 18 coaxial with the axis OO' of the thruster, the annular groove 15, the secondary ducts 16, the distributor 17 and the main duct 18 forming the gas supply circuit 5. The whole of the magnetic circuit is made in soft iron.

The annular outer wall 7 of the magnetic circuit 4 includes a first annular magnet 19, a so-called peripheral magnet, the magnetization of which is oriented north-south in the upstream-to-downstream direction and the annular inner wall 6 includes a second annular magnet 20, a so-called central magnet, the magnetization of which is oriented north-south in the downstream-to-upstream direction, opposite to the magnetization of the first annular magnet 19, so as to generate a magnetic field independent of the azimuth. With such a layout of the magnets 19 and 20, lenticular field geometry may be provided in the outlet area of the ejection channel ensuring good convergence of the ions. Further, it will be noted that the position of the magnets 19, 20, their dimensions and the gap 14 provide a magnetic field, for which the radial component is zero in the area of the anode.

Each of the magnets 19 and 20 may be solid or advantageously consist of a plurality of magnetic elements positioned in a circular way. It will be observed that the magnetization of the peripheral magnet 19 may be oriented south-north in an upstream-to-downstream direction and the magnetization of the central magnet 20 may be oriented south-north in the downstream-to-upstream direction without however departing from the scope of the invention. Each magnetic element of the peripheral 19 and/or central 20 magnet has a determined power. Further the magnetic elements are advantageously cylinders obtained in a hard metal SmCo alloy for example which has the advantage of having high magnetomotive forces.

According to an alternative embodiment of the plasma thruster, the peripheral 19 and/or central 20 peripheral magnet includes magnetic elements and one or more amagnetic elements. It will be noted that in this exemplary embodiment, each magnetic element may have a particular power, the whole of the magnetic and amagnetic elements being laid out so as to generate a magnetic field independent of azimuth. It will be observed that by using magnetic elements, annular magnets may be made of different diameters and/or of different heights so as to adapt to the geometry and dimensions of a thruster or, for a determined thruster geometry, to adapt the magnetomotive force by replacing magnetic elements by amagnetic elements. According to another alternative embodiment, not shown in the figures, the peripheral 19 and/or central 20 magnet is substituted with a toric magnet having radial magnetization, the centre of the torus coinciding with the axis OO' of the plasma thruster.

By a magnetic field independent of azimuth is meant a magnetic field, the value of which is globally constant for an altitude (z) along the given axis of revolution OO' and radius (r), i.e. a magnetic field independent of azimuth (θ) or the value of which varies by less than 1% as a function of azimuth (θ). Indeed, it will be noted that although the magnetic field produced by the annular magnets is independent of azimuth (θ) for a given altitude (z) and radius (r), measurement of the magnetic field with a gaussmeter may vary, considering the measurement uncertainties and the lack of alignments between the axis OO' of the plasma engine and the axis of rotation of the probe of the gaussmeter.

Figure 3:
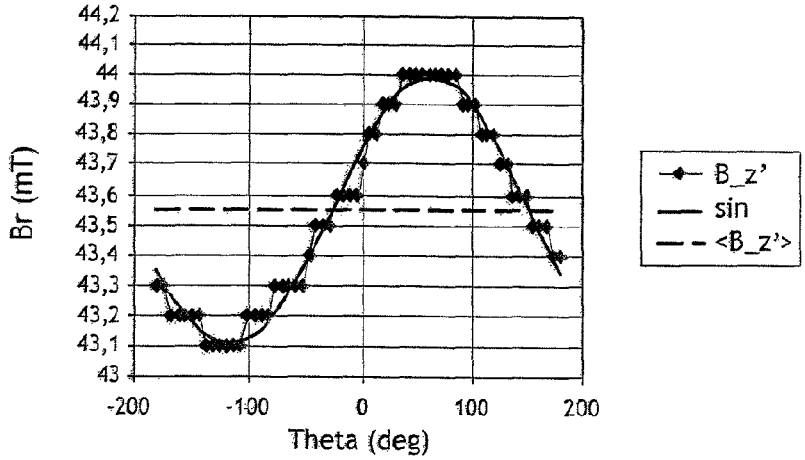
FIG. 3 is a graphic illustration of the magnetic flux density of the magnets of the plasma thruster versus azimuth.

A measurement of the magnetic flux density was conducted, with reference to FIG. 3, by means of a three-dimensional gaussmeter in order to measure the magnetic field versus azimuth ($-180° < \theta < +180°$) in an area of the outlet plane of the plasma thruster while being located on the average radius (r=19 mm). The component Br is constant regardless of azimuth. Br=43.55±0.31 mT. This is a fluctuation of less than one percent (0.7%). However, upon analyzing Br (θ) more extensively, a systematic sinusoidal type of variation is observed for which the period is 360 degrees (FIG. 3). This fluctuation is due to a slight centering defect of the axis OO' of the engine with the axis of the gaussmeter. Indeed, if the axis OO' of the plasma engine does not strictly coincide with the axis of rotation of the probe-holder of the gaussmeter, the θ measurement is sensitive to the variation of Br with the radius r.

Figure 4:
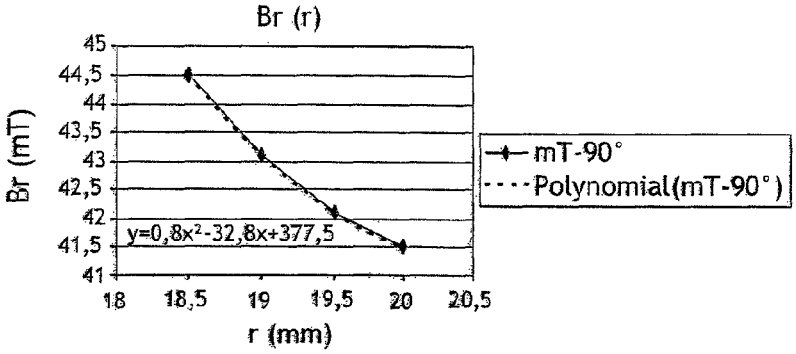
FIG. 4 is a graphic illustration of the variations of the Br component of the magnetic field versus the radius r, around the average radius for a determined angle.

As an example, FIG. 4 illustrates the variations of Br versus the radius r, around the average radius (r=19 mm) for an angle θ equal to −90 degrees as well as a reference curve of a second degree polynomial. Similar curves were measured every 90 degrees, whereby sensitivity of the field may be defined for a variation of radius around r=19 mm:

$$\Delta B/\Delta r = 2.7 \text{ mT/mm}$$

By considering that the decentering amplitude is $r_0$, then the variation of the position of the probe during one turn is written as $$\Delta r(\theta) = r_0 \sin(\theta - \Phi)$$

wherein Φ is the azimuth of the actual centre of rotation. This causes variation of Br:

$$\begin{aligned} \Delta Br(\theta) &= \Delta Br/\Delta r * \Delta r(\theta) \\ &= (\Delta B/\Delta r) * r_0 \sin(\theta - \Phi) \\ &= b_0 \sin(\theta - \Phi) \end{aligned}$$

The reference curve in FIG. 4 which is a best fit to the measurement has the parameters $b_0$=0.445 mT Φ=28 degrees Considering the value ΔB/Δr=2.7 mT/mm, the decentering amplitude may be inferred therefrom:

$r_0$=0.165 mm i.e., a total fluctuation of 0.33 mm on a complete turn of the probe of the gaussmeter.

Figure 5:
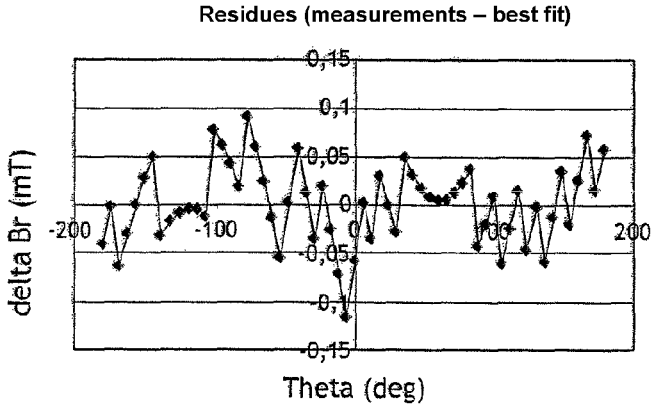
FIG. 5 is a graphic illustration of the deviation between the measured values of the Br component of the magnetic field and the function illustrating the best adjustment.

Finally, FIG. 5 shows the deviation between the measurements and their best fit by a sine function. The gross azimuthal variation of the magnetic field is less than 1% before taking into account the alignment defect between the axis OO' of the plasma engine and the axis of rotation of the probe of the gaussmeter. Taking into account this systematic error, the actual azimuthal variation of the field becomes less than 0.1 mT (in fact the standard deviation of the residues is 0.04 mT, i.e. 0.1%); it is therefore the accuracy of the gaussmeter (+/−0.1 mT) which limits the accuracy of the determination of the azimuthal homogeneity of the magnetic field. Therefore, the magnetic field produced by the annular magnet assembly has excellent azimuthal homogeneity, which is theoretically constant, but limited to the accuracy of the present measuring instrument (0.25%).

Moreover, the plasma thruster according to the invention includes a main ionization and acceleration annular channel 21 consisting of an inner annular wall 22 and of an outer annular wall 23 coaxial with the axis OO', obtained in an electrically insulating material such as BN:$SiO_2$ ceramic for example, said annular channel 21 extending from the bottom 8 as far as to the lumen 10 of the magnetic circuit 4. This annular channel 21 obtained in a refractory material provides electric insulation between the area of the plasma which is formed in said annular channel 21 and the magnetic circuit 4, as this will be detailed later on. The downstream end of the annular channel 21, i.e. the end of the annular channel, supported on the bottom 8 of the magnetic circuit 4, is closed by a porous ceramic 24 with an annular shape extending opposite the annular recess 14 forming a gap and opening out onto the annular groove 15 for supplying a noble gas. With this porous ceramic 24, it is notably possible to provide controlled and homogeneous diffusion of the gas into the annular channel 21. It will be observed that this porous ceramic 24 may advantageously be adapted to all the plasma thrusters of the prior art such as those described in the American U.S. Pat. No. 5,359,258 and U.S. Pat. No. 6,281,622 and patent application FR 2 842 261 for example in order to provide controlled and homogeneous diffusion of the gas into the annular channel.

The outer annular wall 23 of the annular channel 21 advantageously includes an annular protrusion 25 extending between the middle portion of the annular channel 21 and the bottom of the magnetic circuit 4 providing local shrinkage of said annular channel 21 in order to avoid a breakdown of the inner 22 and/or outer 23 walls of the latter. Between the annular protrusion 25 and the upstream end of the annular channel 21, the plasma thruster includes an annular anode 26 extending in the middle portion of said annular channel 21 and connected to a biasing cable 27 extending radially and crossing the outer walls 7 and 23 respectively of the magnetic circuit 4 and of the annular channel 21 through radial holes 28 and 29. The plasma thruster moreover includes at least one cathode 30 and preferably two cathodes, extending at the outlet of the annular channel 21 in order to generate between said anode 26 and cathode(s) 30, an electric field oriented in the axial direction OO', while being outside the propulsion jet, in order to generate a plasma.

Figure 6:
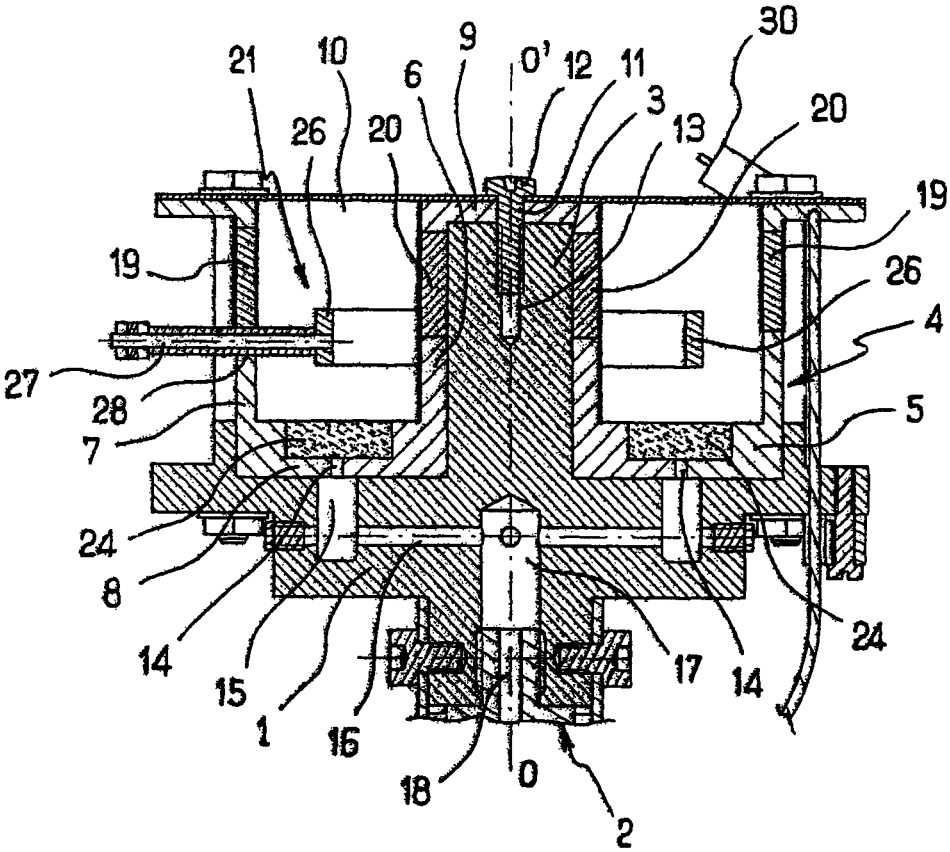
FIG. 6 is an axial sectional view of an alternative embodiment of the plasma thruster according to the invention.

Advantageously, the base 1 of the plasma thruster according to the invention will be obtained in a heat-conducting material such as copper for example in order to ensure removal of the heat produced by the plasma being formed in the annular channel 21, the copper base 1 thereby forming a thermal regulation circuit. According to a last particularly advantageous alternative embodiment of the device according to the invention, with reference to FIG. 6, the peripheral 19 and/or central 20 magnets may be obtained in hard magnetic ceramics such hexaferrites, while the whole of the magnetic circuit 4 may be obtained in soft magnetic ceramics such as spinelle ferrites. Indeed, the magnetic circuits of the plasma thrusters of the prior art and the alternative embodiment described earlier are made in soft iron such as Armco Iron, which has very high saturation magnetization (2.2 T), and also a very high Curie point (770° C.). This is a relatively soft material therefore only requiring moderate magnetic fields in order to be magnetized. However, the magnetic circuit 4 is a circuit with a gap 14 in which the actual magnetization fields are markedly stronger than in a closed circuit.

Thus, in order to optimize not only the value of the radial magnetic field but also the spatial distribution of the thrusters of the prior art, soft iron screens had also to be placed. These screens delimit the annular channel 21 and form a short circuit for the ions and electrons in the channel, said screens are conductors of electricity so that the plasma thrusters of the prior art in fine include insulating ceramics in order to avoid the electric short-circuit effect of the screens. By substituting soft ferromagnetic portions of the magnetic circuit 4 with soft ferrites (spinelle structure) and the metal magnets with hard ferrites, so-called hexaferrites (hexagonal structure) for example, it is possible to suppress the insulating ceramic of the annular channel 21 in which the plasma is formed. Thus, in this alternative embodiment, the plasma thruster in the same way as earlier consists of a base 1 having an axisymmetrical shape around an axis OO' and including in its downstream portion, a noble gas supply circuit 2 and in its upstream portion, a cylindrical central core 3.

The thruster moreover includes a magnetic circuit 4 obtained in a soft ferrite such as a ferrite with a spinelle structure and consisting of a crown 5 with U-shaped section, comprising an inner wall 6, an outer wall 7 and a bottom 8 connecting the inner 6 and outer 7 walls and forming the downstream portion of the magnetic circuit 4. The upstream portion of the magnetic circuit 4 consists of a disk 9 capping the crown 5. Said disk 9 includes an annular lumen 10 extending opposite the bottom 8 of the crown 5, and a hole 11 for letting through a screw 12 (FIG. 1) with which the magnetic circuit 4 may be firmly secured to the base 1, the central core 3 including a tapped hole (13 capable of receiving the screw 12. The magnetic circuit 4 moreover includes in its bottom an annular recess forming a gap 14 and opening out onto an annular groove 15 fed by the gas supply circuit 5. The whole of the magnetic circuit 4 is made in soft ferrites such as soft ferrites of general formula $MFe_2O_4$ or MO, $Fe_2O_3$, (M=divalent metal, or a combination of divalent metals) for example. Generally, the magnetic circuit 4 may be made in soft ferrite as notably described in the publication J. Smit and H. P. J. Wijn, "Ferrites", Philips Tech Library (1959).

The annular outer wall 7 of the magnetic circuit 4 includes a first annular magnet 19, a so-called peripheral magnet, for which the magnetization is oriented north-south in the upstream-to-downstream direction and the annular inner wall 6 includes a second annular magnet 20, a so-called central magnet, for which the magnetization is oriented north-south in the downstream-to-upstream direction, opposite to the magnetization of the first annular magnet 19, so as to generate a magnetic field independent of azimuth. With such a layout of the magnets 19 and 20, a lenticular field geometry may be provided in the outlet area of the ejection channel ensuring good convergence of the ions. Further, it will be noted that the position of the magnets 19, 20, their dimensions and the gap 14 provide a magnetic field, for which the radial component is zero in the area of the anode.

Each of the magnets 19 and 20 may be solid or may advantageously consist of a plurality of magnetic elements positioned in a circular way. Moreover, the magnetic elements are advantageously cylinders obtained in hard ferrite or hexaferrite as notably described in the publication J. Smit and H. P. J. Wijn, "Ferrites", Philips Tech Library (1959).

Moreover, the plasma thruster according to the invention includes a main ionization and acceleration annular channel 21, consisting of the inner 6 and outer 7 annular walls of the magnetic circuit 4; by using soft ferrites for the magnetic circuit 4 and hard ferrites for the magnets, it is possible to suppress the annular crown 5 as this has been seen earlier. The downstream end of the magnetic circuit 4 is advantageously closed by an annular part 24 obtained in a porous refractory material and positioned in the bottom of the annular channel 21. This annular part 24 is obtained in a porous ceramic and extends opposite the annular recess 14 forming a gap while opening out onto the noble gas supply annular groove 15, said porous ceramic 24 being notably able to provide controlled and homogeneous diffusion of the gas into the annular channel 21.

The plasma thruster includes an annular anode 26 extending into the middle portion of said annular channel 21 and connected to a biasing cable 27 extending radially and crossing the outer wall 7 of the magnetic circuit 4 through a radial hole 28. The plasma thruster moreover includes at least one cathode 30 and preferably two cathodes, extending at the outlet of the annular channel 21 in order to generate between said anode 26 and the cathode(s) 30, an electric field oriented in the axial direction OO', while being outside the propulsion jet, in order to generate a plasma.

It will be noted that the magnets 19 and/or 20 and/or all or part of the magnetic circuit 4 may for example be substituted with NiZn ferrites ($Ni_{1-x}Zn_xFe_2O_4$); a zinc content, x, comprised between 0.2 and 0.4 would be the good compromise between magnetization and Curie temperature at the operating temperature of the plasma thruster. Moreover, it is quite obvious that the invention may be applied by substitution of the magnets and/or of all or part of the magnetic circuit of the plasma thrusters of the prior art, such as the plasma thrusters described in the American U.S. Pat. No. 5,359,258 and U.S. Pat. No. 6,281,622 and French patent application FR 2 842 261 for example, without however departing from the scope of the invention. Further, it is quite obvious that only the magnets 19 and/or 20 may be substituted with hard ferrites (hexaferrites) without however departing from the scope of the invention. Finally, it is obvious that the examples which have just been given are only particular illustrations and by no means limiting as to the fields of application of the invention.

The invention claimed is:

1. A Hall effect ion ejection device having a longitudinal axis substantially parallel to an ion ejection direction, the device comprising:

a main ionization and acceleration annular channel, the annular channel being open at its end;

an anode extending inside the channel;

a cathode extending outside the channel, at the outlet of the latter; and a magnetic circuit for generating a magnetic field in a portion of the annular channel, the circuit comprising at least one annular inner wall, one annular outer wall and a bottom connecting the inner and outer walls and being the downstream portion of the magnetic circuit, wherein the magnetic circuit is laid out so as to generate at the outlet of the annular channel a magnetic field independent of azimuth and in the area of the anode, a magnetic field for which the radial component is zero.

2. The device according to claim 1, further comprising a so-called central annular permanent magnet, integral with the inner wall of the magnetic circuit, and a peripheral annular permanent magnet integral with the outer wall of the magnetic circuit and for which the magnetization direction is opposite to that of the central magnet.

3. The device according to claim 2, wherein at least one of the magnets is obtained in hard hexaferrites.

4. The device according to claim 1, wherein the bottom includes an annular through-recess forming a gap.

5. The device according to claim 1, wherein at least one of the magnets includes a plurality of magnetic elements positioned in a circular manner.

6. The device according to claim 5, wherein at least one of the magnets includes at least one amagnetic elements.

7. The device according to claim 5, wherein each magnetic element of at least one of the magnets has a determined power.

8. The device according to claim 5, wherein the elements of at least one of the magnets are cylinders obtained in a metal SmCo alloy.

9. The device according to claim 1, wherein the magnetic circuit is obtained in soft ferrites.

10. The device according to claim 9, wherein the soft ferrites are selected from the following list of ferrites of general formula $MFe_2O_4$ or MO, $Fe_2O_3$ 3 wherein M designates a divalent metal atom or a combination of atoms for which the overall valence is 2.

11. The device according to claim 1, wherein it includes an annular part obtained in a porous refractory material and positioned in the bottom of the annular channel in order to cap the gap and close the bottom of the annular channel.

12. The device according to claim 11, wherein the annular part is obtained in porous ceramic.

13. The device according to claim 1, wherein the anode has an annular shape and extends in the middle portion of the annular channel.

14. A Hall effect plasma thruster comprising:

a main ionization and acceleration annular channel, the annular channel being open at its end;

an anode located inside the channel;

a cathode located outside the channel; and a magnetic field being in at least a portion of the annular channel, the circuit comprising an annular inner wall, an annular outer wall and a surface connecting the inner and outer walls, wherein the magnetic circuit generates a magnetic field independent of azimuth at the outlet of the annular channel and in the area of the anode, a radial component of the magnetic field is substantially zero; and wherein Hall effect ion ejection causes plasma thrust.

15. The thruster according to claim 14, further comprising a central annular permanent magnet, integral with the inner wall of the magnetic circuit and a peripheral annular permanent magnet integral with the outer wall of the magnetic circuit and for which the magnetization direction is opposite to that of the central magnet.

16. The thruster according to claim 14, wherein the surface includes an annular through-recess forming a gap.

17. A Hall effect ion ejection apparatus comprising:

a main ionization and acceleration annular channel, the annular channel being open at its end;

an anode located inside the channel;

a cathode located outside the channel; and a magnetic field being in at least a portion of the annular channel, the circuit comprising an annular inner wall, an annular outer wall and a surface connecting the inner and outer walls, wherein the magnetic circuit generates a magnetic field independent of azimuth at the outlet of the annular channel and in the area of the anode, a radial component of the magnetic field is substantially zero; and wherein the Hall effect ion ejection causes a surface treatment by ion implantation.

18. The apparatus according to claim 17, further comprising a central annular permanent magnet, integral with the inner wall of the magnetic circuit and a peripheral annular permanent magnet integral with the outer wall of the magnetic circuit and for which the magnetization direction is opposite to that of the central magnet.

* * * * *